US010011288B2

(12) United States Patent
Gagliardino et al.

(10) Patent No.: US 10,011,288 B2
(45) **Date of Patent: *Jul. 3, 2018**

(54) RAILCAR COUPLER SYSTEM AND METHOD

(71) Applicant: McConway & Torley, LLC, Dallas, TX (US)

(72) Inventors: Joseph L. Gagliardino, Oakdale, PA (US); P. Scott Mautino, Pittsburgh, PA (US); Randall W. Schudalla, Cranberry Township, PA (US); George S. Creighton, Pompano Beach, FL (US); Richard G. McMillen, Pittsburgh, PA (US)

(73) Assignee: McConway & Torley, LLC, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/739,512

(22) Filed: Jun. 15, 2015

(65) Prior Publication Data

US 2015/0274181 A1 Oct. 1, 2015

Related U.S. Application Data

(63) Continuation of application No. 13/063,426, filed as application No. PCT/US2009/057254 on Sep. 17, 2009, now Pat. No. 9,056,618.

(Continued)

(51) Int. Cl.
*B61G 3/04* (2006.01)
*B22D 25/02* (2006.01)

(52) U.S. Cl.
CPC ..... *B61G 3/04* (2013.01); *B22D 25/02* (2013.01)

(58) Field of Classification Search
CPC ... B61G 3/00; B61G 3/04; B61G 3/06; B61G 7/00; B61G 9/06

(Continued)

(56) References Cited

U.S. PATENT DOCUMENTS 3,854,599 A 12/1974 Day et al.
4,081,082 A 3/1978 Scherrer et al.

(Continued)

FOREIGN PATENT DOCUMENTS

AU 2009293254 9/2009
CN 86100271 A 7/1987

(Continued)

OTHER PUBLICATIONS

International Search Report & Written Opinion, Application No. PCT/US2009/057254, 8 pages, dated Nov. 2009.

(Continued)

*Primary Examiner* — Zachary L Kuhfuss
(74) *Attorney, Agent, or Firm* — Baker Botts, LLP

(57) ABSTRACT

A railcar coupler includes a coupler head portion extending from a shank portion. The coupler head portion is configured to couple to a first coupler knuckle for coupling the railcar coupler to a second railcar coupler of an adjacent railcar. The coupler head portion comprises a nose portion and a gathering face extending from the nose portion for engaging a second coupler knuckle coupled to the second railcar coupler. The coupler head portion comprises a guard arm portion extending from the nose portion towards the shank portion. The coupler head portion comprises a horn portion having a back surface. A distance between the back surface of the horn portion and a nose end of the guard arm portion is less than 11 inches. The coupler head portion comprises a locklifter shelf less than 2 inches above a bottom edge of the coupler.

6 Claims, 7 Drawing Sheets

Related U.S. Application Data

(60) Provisional application No. 61/192,411, filed on Sep. 17, 2008.

(58) Field of Classification Search
USPC ... 213/75 R, 100 R, 104, 105, 109, 150–154
See application file for complete search history.

(56) References Cited

U.S. PATENT DOCUMENTS

| | | | | |
|---|---|---|---|---|
| 4,984,696 | A | 1/1991 | Altherr | |
| 5,312,007 | A | 5/1994 | Kaufhold et al. | |
| 6,148,733 | A | 11/2000 | Gagliardino | |
| 7,624,884 | B2 | 12/2009 | Palermo et al. | |
| 8,196,912 | B2 | 6/2012 | Carlstedt et al. | |
| 9,038,836 | B1 * | 5/2015 | Tavares | B61G 3/04 213/154 |
| 9,056,618 | B2 * | 6/2015 | Gagliardino | B61G 3/04 |
| 9,669,848 | B2 * | 6/2017 | Creighton | B61G 9/10 |
| 9,701,323 | B2 * | 7/2017 | Manibharathi | B61G 3/08 |
| 2002/0070189 | A1 | 6/2002 | Barker et al. | |
| 2002/0108920 | A1 | 8/2002 | Carlstedt | |
| 2008/0128377 | A1 | 6/2008 | Mautino et al. | |
| 2013/0168346 | A1 | 7/2013 | Wilt et al. | |
| 2015/0014267 | A1 * | 1/2015 | Creighton | B61G 9/10 213/65 |
| 2016/0339930 | A1 * | 11/2016 | Stern | B61G 3/04 |

FOREIGN PATENT DOCUMENTS

| | | | |
|---|---|---|---|
| CN | 101541614 | A | 9/2009 |
| CN | 102159440 | A | 8/2011 |
| EP | 1060971 | A1 | 12/2000 |

OTHER PUBLICATIONS

Notification concerning Transmittal of International Preliminary Report on Patentability and Written Opinion regarding PCT/US2009/057254; The International Bureau of WIPO—Switzerland; pp. 7, dated Mar. 2011.

Extended European Search Report: Application No. 09815167.3-2422; pp. 4, dated Jan. 2013.

The first Office Action of the Intellectual Property Office of the People's Republic of China, with English Translation; Application No. 200980136542.9; pp. 17, dated Feb. 2013.

The second Office Action of the Intellectual Property Office of the People's Republic of China; Application No. 200980136542.9; pp. 16, dated Sep. 2013.

Office Action of the Intellectual Property Office of the People's Republic of China; Application No. 200980136542.9; pp. 18, dated Mar. 2014.

Office Action of the Mexican Patent Office with English translation; Application No. MX/a/2011/002758; pp. 4, dated Aug. 2014.

Office Action issued by the Canadian Intellectual Property Office for Application No. 2,736,509—dated Feb. 6, 2017.

Office Action issued by the Canadian Intellectual Property Office for Application No. 2,965,154, dated Oct. 16, 2017; 4 pages.

The Third Office Action received from the State Intellectual Property Office of the People's Republic of China for Application No. 200980138542.9; Applicant: McConway & Torley, LLC—dated Aug. 18, 2016.

Office Action issued by the Chinese Intellectual Property Office for Application No. 201580045937.3, dated Mar. 13, 2018; 18 pages.

Office Action issued by the India Intellectual Property Office for Application No. 1729/DELNP/2011, dated Mar. 28, 2018; 6 pages.

* cited by examiner

RAILCAR COUPLER SYSTEM AND METHOD

RELATED APPLICATIONS

This application is a continuation of U.S. application Ser. No. 13/063,426 filed Mar. 10, 2011, entitled "RAILCAR COUPLER SYSTEM AND METHOD," which is a U.S. National Stage Application of International Application No. PCT/US2009/057254 filed Sep. 17, 2009, which designates the United States and claims priority to U.S. Patent Application Ser. No. 61/192,411, entitled "RAILCAR COUPLER SYSTEM AND METHOD," which was filed on Sep. 17, 2008, which are hereby incorporated by reference in their entirety.

TECHNICAL FIELD

This invention relates in general to railcars and, more particularly, to a railcar coupler system and method.

BACKGROUND

Railcar couplers are disposed at each end of a railway car to enable joining one end of such railway car to an adjacently disposed end of another railway car. The engageable portions of each of these couplers is known in the railway art as a knuckle. For example, railway freight car coupler knuckles are taught in U.S. Pat. Nos. 4,024,958; 4,206,849; 4,605,133; and 5,582,307.

In many cases when a railcar coupler fails, a replacement coupler must be transported from the locomotive at least some of the length of the train, which may be up to 25, 50 or even 100 railroad cars in length. The repair of a failed coupler can be labor intensive, can sometimes take place in very inclement weather and can cause train delays.

SUMMARY

Particular embodiments provide a railcar coupler system and method that substantially eliminates or reduces at least some of the disadvantages and problems associated with previous systems and methods.

In accordance with a particular embodiment, a railcar coupler includes a coupler head portion extending from a shank portion. The coupler head portion is configured to couple to a first coupler knuckle for coupling the railcar coupler to a second railcar coupler of an adjacent railcar. The coupler head portion comprises a nose portion and a gathering face extending from the nose portion for engaging a second coupler knuckle coupled to the second railcar coupler. The coupler head portion comprises a guard arm portion extending from the nose portion towards the shank portion. The coupler head portion comprises a horn portion having a back surface. A distance between the back surface of the horn portion and a nose end of the guard arm portion is less than 11 inches. The coupler head portion comprises a locklifter shelf less than 2 inches above a bottom edge of the coupler. The shank portion comprises a key slot having a length greater than 8 inches.

Technical advantages of particular embodiments include a railcar coupler that is reconfigured to allow for longer travel during railcar coupling. In some embodiments, the coupler has a width reduced by approximately 1.25 inches. Generally, in particular embodiments that back of the coupler horn is moved 1.25 inches. In addition, in particular embodiments the locklifter shelf is moved down approximately 0.5 inches to prevent it from impacting the draft sill of the striker. In some embodiments, the shank slot is elongated by approximately 2.125 inches to further allow for longer travel. The changes made to the coupler allow for longer travel while still enabling the coupler to work with configuration of existing parts, such as existing locks and knuckles. The longer travel also enables the coupler draft gear to absorb more energy during coupling.

Other technical advantages will be readily apparent to one skilled in the art from the following figures, descriptions and claims. Moreover, while specific advantages have been enumerated above, various embodiments may include all, some or none of the enumerated advantages.

BRIEF DESCRIPTION OF THE DRAWINGS

For a more complete understanding of the present invention and its advantages, reference is now made to the following description, taken in conjunction with the accompanying drawings, in which.

DETAILED DESCRIPTION

Figure 1:
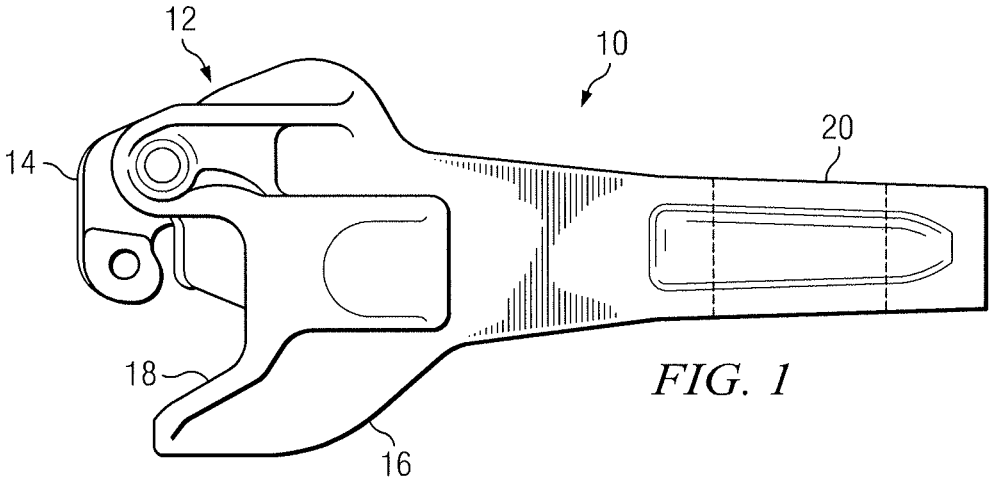
FIG. 1 is a top view of a typical railcar coupler.
Figure 2:
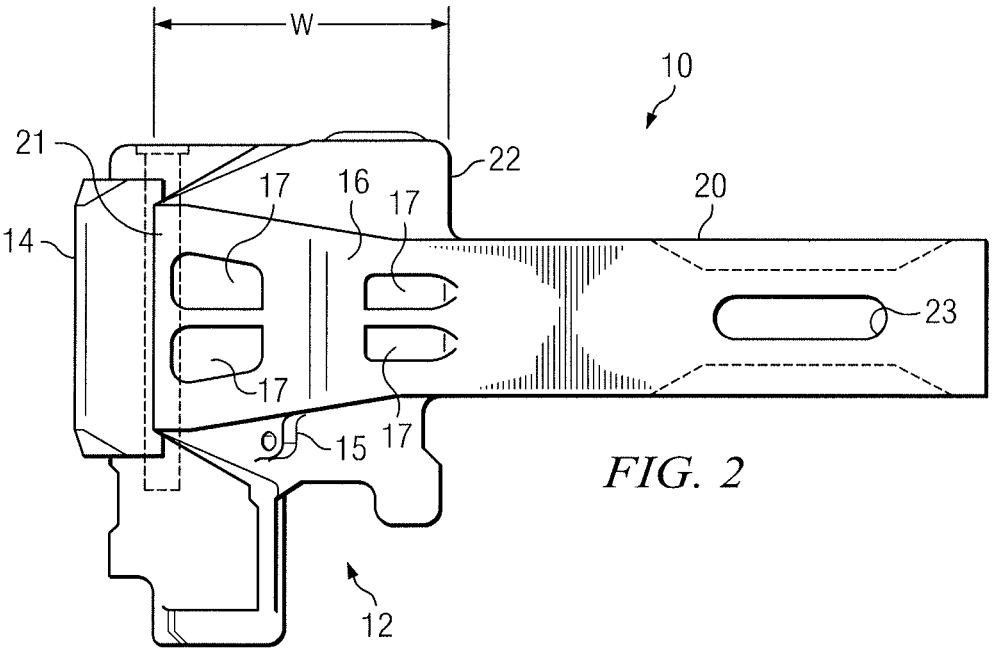
FIG. 2 is a side view of the railcar coupler of FIG. 1.

FIGS. 1 and 2 illustrate a coupler 10 for freight railway cars in accordance with standard specifications as set forth by the Mechanical Committee of Standard Coupler Manufacturers. Coupler 10 is mounted within a yoke secured at each end of a railway car center sill, such that it may extend outwardly under an end of a railway car to engage a similar coupler extending outwardly under an end of an adjacent railway car. Coupler 10 includes a generally V-shaped coupler head 12 at a forward end extending from a shank 20. Shank 20 includes a shank slot 23 and is adapted to be fitted within and attached to a yoke secured at each end of a center sill extending full length under the railway car at a longitudinal axis. Shank slot 23 is approximately 6.875 inches long in conventional couplers.

Coupler head 12 has a vertical-knuckle 14 rotatably pinned at an outer end of coupler head 12 forming a first leg of coupler head 12, while a second leg of coupler head 12 comprises a fixed and rigid guard arm portion 16 with cavities 17. Coupler 10 also includes a first angled gathering surface 18 against which a vertical-knuckle 14 on a mating coupler similar to coupler 10 is intended to impact when two adjacent railway cars are brought together. When vertical knuckle 14 impacts against an angled gathering face 18 of another coupler, it and the opposing vertical knuckle 14 are each pivoted inwardly to a degree sufficient to lock them in place behind each other so that the couplers 10 are properly joined together. A lock member slidably disposed within each coupler head 12 may be activated by the engagement to slide downwardly within the coupler head 12 and lock the vertical knuckle 14 in place to thereby join the two railway cars together. Coupler 10 additionally includes a chain lug 15. To assure a successful coupling, the two railway cars may be sitting on a straight length of track, and the two couplers, like coupler 10, may be at least generally oriented parallel to the track and perpendicular to the end of the railway car to face each other.

The referenced width W is a distance extending from the nose end 21 of guard arm portion 16 to back surface 22. Because of high impact forces during coupling, whether resulting from trains traveling faster than five miles per hour during the process or otherwise, cracks may form around back surface 22 (e.g., in some cases as a result of impacting a striker). To minimize these cracks and other wear on the coupler, in particular embodiments the same width W of a coupler may be reduced to allow for longer travel during coupling resulting in higher absorption of energy.

Figure 3:
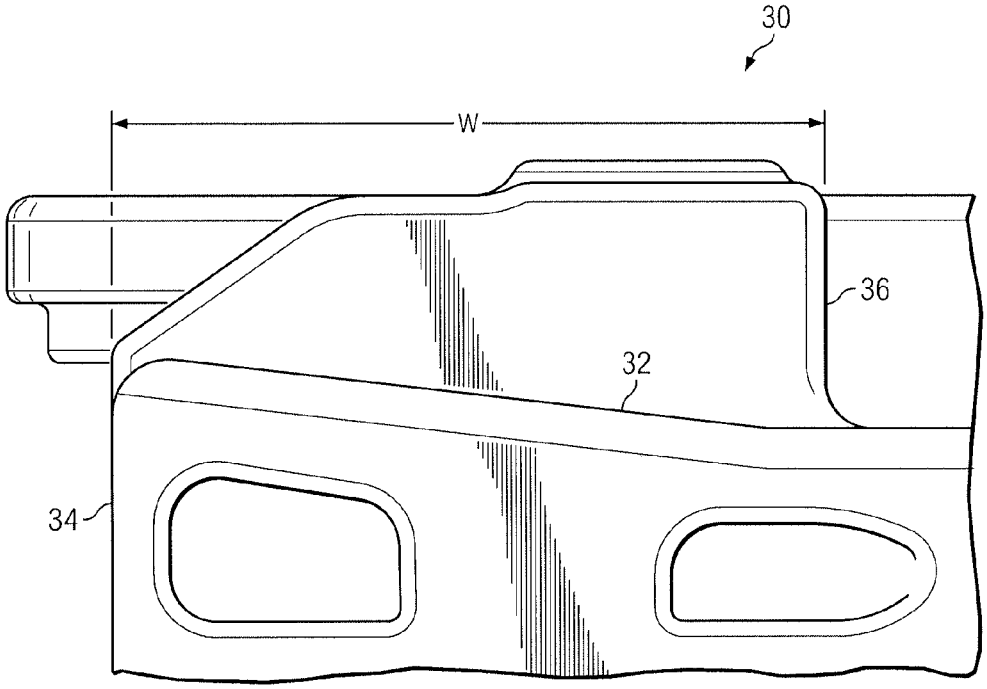
FIG. 3 is a partial view of a railcar coupler, in accordance with a particular embodiment.

FIG. 3 illustrates a coupler 30, in accordance with a particular embodiment. Coupler 30 includes a guard arm portion 32 having an end 34. Coupler 30 also includes a back surface 36 of the coupler horn. As discussed above, to minimize cracks and other wear on the coupler on and around back surface 36, the distance W between an end 34 of the guard arm portion and back surface 36 may be reduced. In the illustrated embodiment, this distance W is approximately 10.75 inches, representing an approximately 1.25 inch reduction in this distance from a conventional coupler. Since the coupling process results in travel of the coupler between the time adjacent couplers engage and the draft gear components (e.g., springs and other components) fully compress and go solid, reducing this distance in this way allows for approximately 1.25 inches more travel for the coupler system components (e.g., coupler, yoke, and draft gear) during coupling before the draft gear components go solid. This additional travel enables the coupler draft gear to absorb higher forces and increased energy during coupling. In some embodiments, the additional travel may enable absorption of 100,000 to 200,000 lbs of increased energy. The additional travel also reduces the possibility that the coupler impacts a railcar striker during coupling.

While in this embodiment distance W is approximately 10.75 inches, other embodiments may include a distance W having another dimension (such as less than 11 inches) but still reduced from the conventional 12 inches to allow for longer travel of the coupler during railcar coupling. In some embodiments, the travel distance of the coupler during coupling may increase from approximately 3.75 inches to greater than 4.5 inches. In embodiments where distance W is approximately 10.75 inches, the travel distance may be approximately 5 inches.

Coupler 30 may be manufactured through a casting process with steel or other alloy. The casting process may include involve a mold cavity within a casting box between cope and drag sections. Sand, such as green sand, may be used to define the interior boundary walls of the mold cavity. The mold cavity may be formed using a pattern and may include a gating system for allowing molten alloy to enter the mold cavity. Generally, the mold cavity may be shaped in a manner such that the cast coupler may have a configuration as described herein with respect to particular embodiments.

Figure 4:
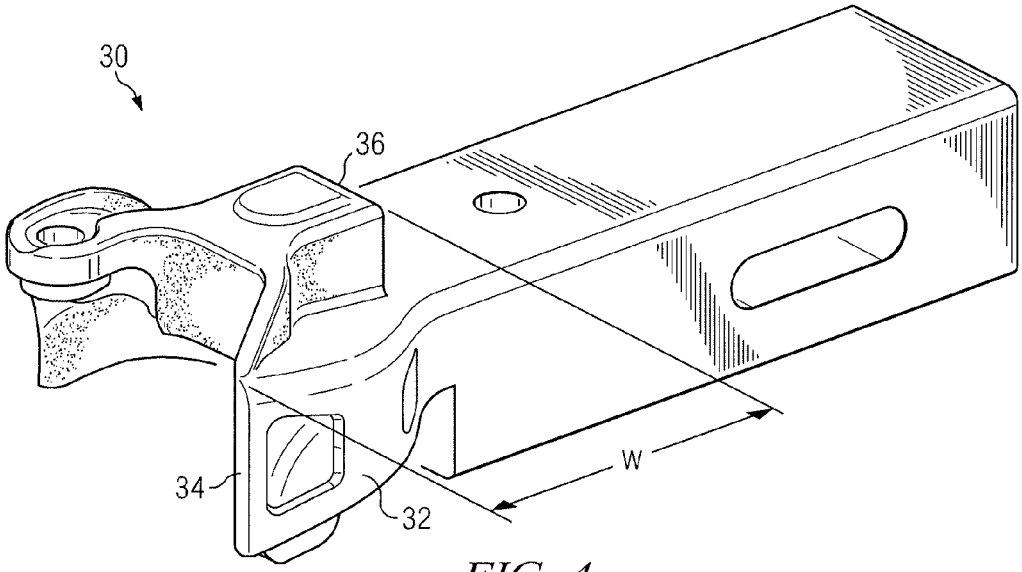
FIG. 4 is a partial isometric view of the railcar coupler of FIG. 3.

FIG. 4 illustrates a partial view of coupler 30 of FIG. 3.

Figure 5:
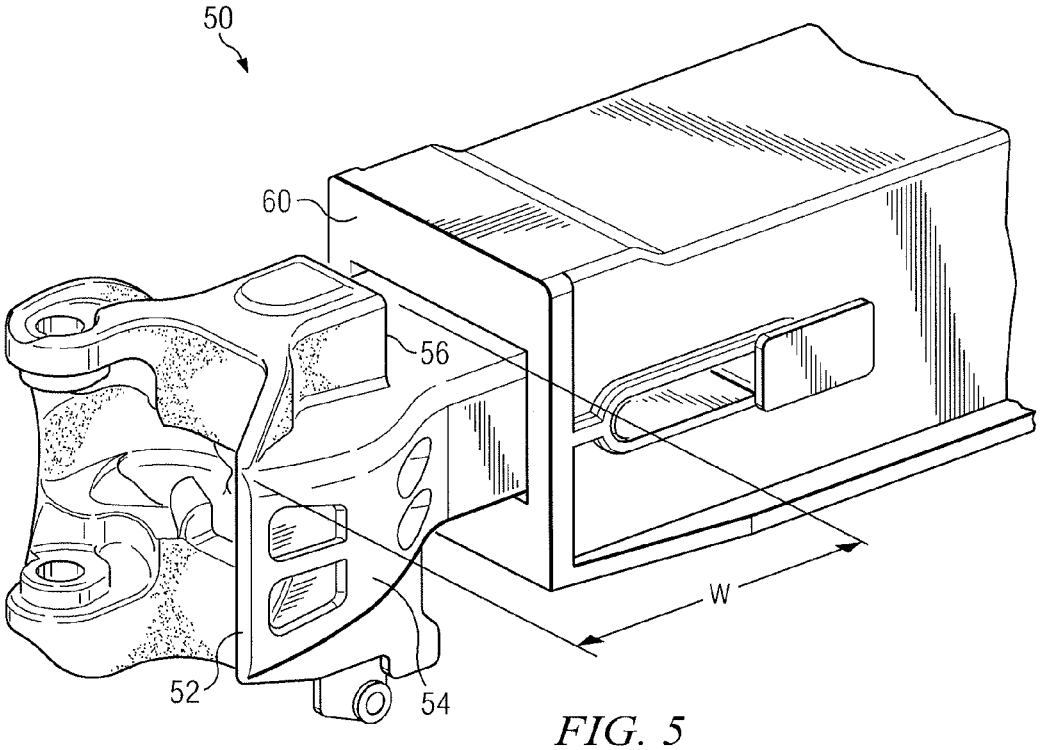
FIG. 5 is an isometric view of a railcar coupler and a striker, in accordance with a particular embodiment.

FIG. 5 illustrates a coupler 50 and striker 60, in accordance with a particular embodiment. Distance W between end 52 of guard arm portion 54 and back surface 56 is approximately 10.75 inches, allowing for approximately 1.25 inches more travel of coupler 50 with respect to striker 60 during railcar coupling. As discussed above, this enables the draft gear to absorb more energy before it goes solid and reduces the chance of impact forces on coupler 50 as a result of potential impact of striker 60 on back surface 56.

Figure 6:
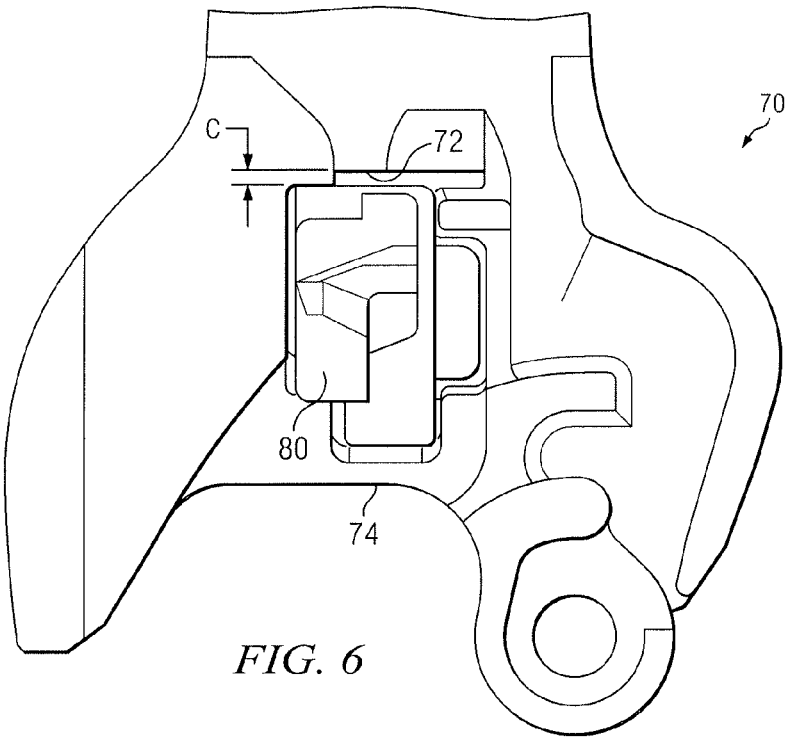
FIG. 6 is a view of a railcar coupler, in accordance with a particular embodiment, with a lock positioned in a lock hole of the railcar coupler.
Figure 7:
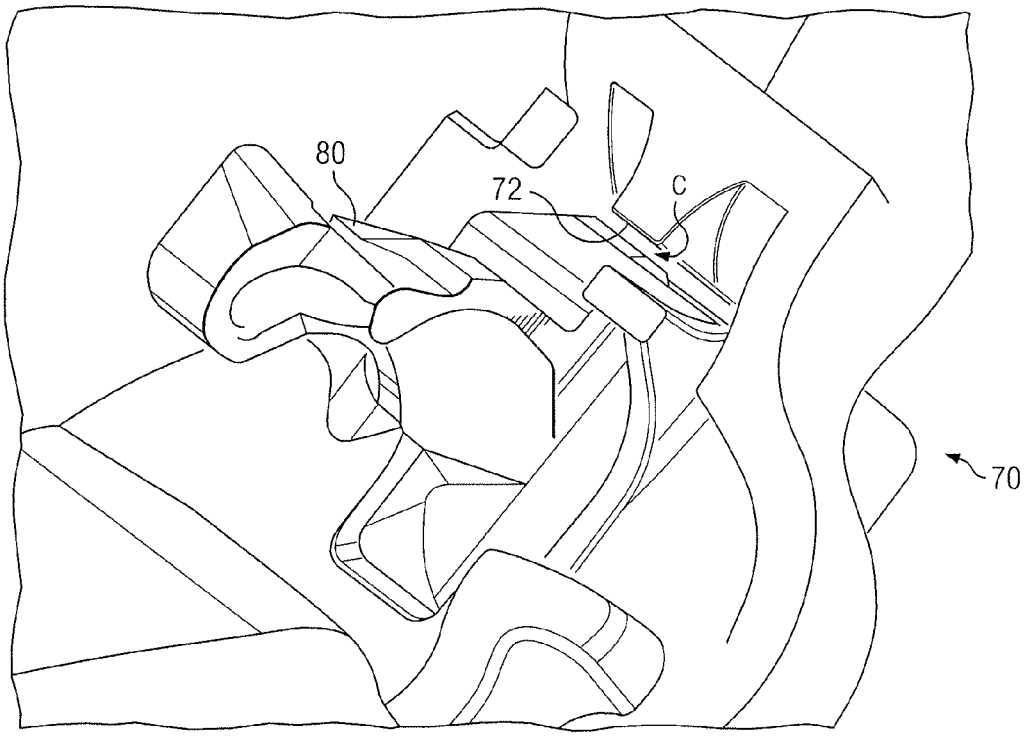
FIG. 7 is another view of the railcar coupler of FIG. 6.
Figure 8:
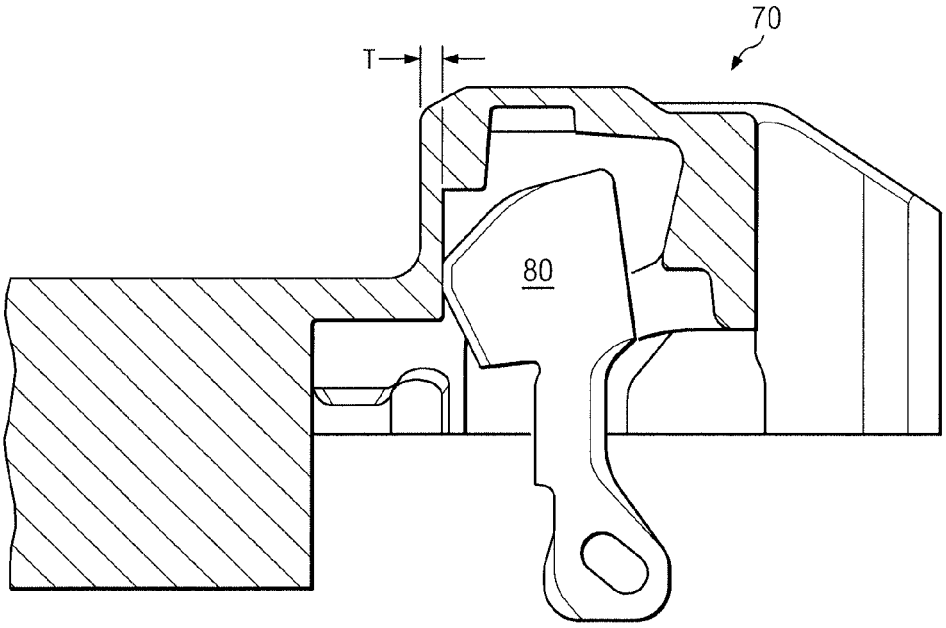
FIG. 8 is a another, partial cut-out view of the railcar coupler of FIG. 6.

FIGS. 6 and 7 illustrate a modified coupler 70, in accordance with particular embodiments that has a similar reduced width described above to allow for longer travel during coupling. Coupler 70 is illustrated to show configuration modifications to allow for the reduced width. Surface 72 of coupler 70 has been reconfigured and moved towards the front face 74 end of the coupler to accommodate the reduced width. Surface 72 borders the lock hole in which lock 80 is positioned during operation. As a result the coupler configuration modifications must still provide for a lock hole sufficient to house lock 80 while still providing for clearance between lock 80 and surface 72. In some embodiments, this clearance is approximately 1/32 inch. As illustrated in FIGS. 7 and 8, sufficient clearance C still exists. Thus, the configuration changes in particular embodiments still enable the coupler to work with configuration of existing parts, such as existing locks and knuckles.

FIG. 8 is a partial, cutout view of coupler 70 of FIG. 6. Coupler 70 has a wall thickness T at the backside of the coupler horn (e.g., the side that faces the striker). In conventional couplers, this wall thickness is approximately 0.73 inches. To accommodate the reduced width in the coupler discussed above to allow for longer travel, the coupler wall thickness is reduced to approximately 0.43 inches in some embodiments. While in this embodiment the wall thickness is reduced approximately 0.30 inches to approximately 0.43 inches, other embodiments may include a different wall thickness that is still reduced from the conventional 0.73 inches to accommodate the reduced coupler width to allow for longer travel of the coupler during railcar coupling.

Figure 9:
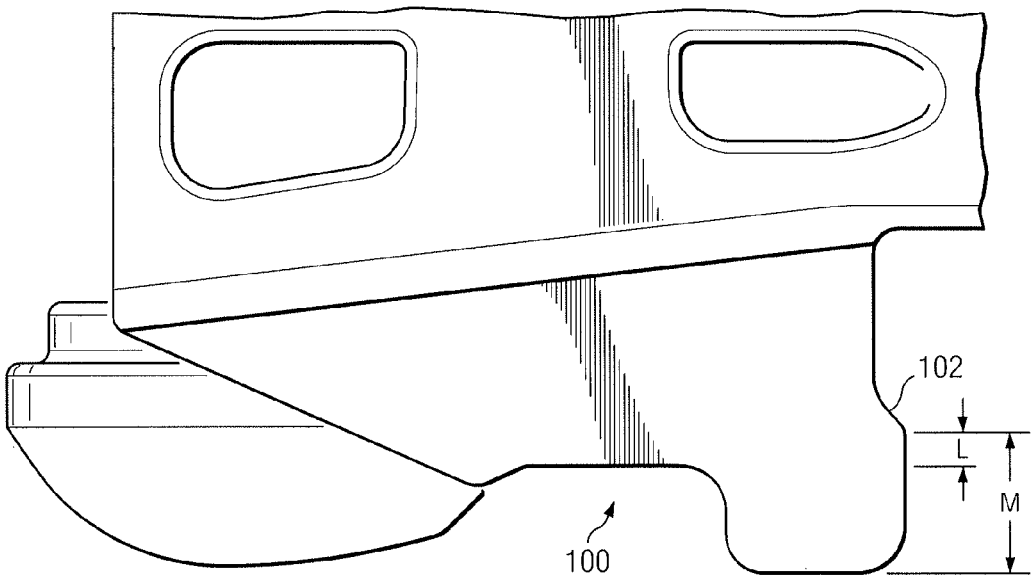
FIG. 9 is a partial view of a conventional railcar coupler.

FIG. 9 illustrates a conventional coupler 100 having a locklifter shelf 102. In some cases, shelf 102 may interfere with a draft sill during travel of the coupler, for example during railcar coupling. Locklifter shelf is a distance M above a bottom edge of the coupler. In conventional couplers, this distance M may be approximately 2.375 inches. To allow for longer travel of the coupler during coupling given the reduced width of particular embodiments described above, in particular embodiments this shelf is lowered by length L such that it is a distance M-L above a bottom edge of the coupler. In some embodiments this length L may be approximately 0.5 inches.

Figure 10:
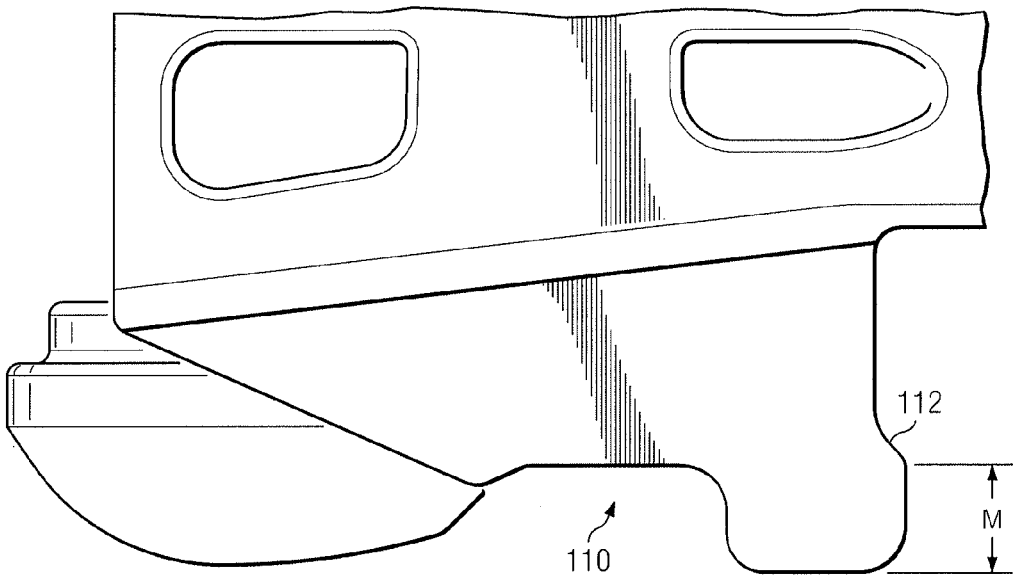
FIG. 10 is a partial view of a railcar coupler, in accordance with a particular embodiment.

FIG. 10 illustrates a coupler 110 in accordance with particular embodiments. Coupler 110 includes a shelf 112 that has been lowered approximately 0.5 inches from its location in a conventional coupler to allow for longer coupler travel without interference with a draft sill during coupling. In this embodiment the shelf is lowered approximately 0.5 inches such that distance M above a bottom edge of the coupler is approximately 1.875 inches. Other embodiments may include a shelf lowered a different amount to minimize interference with a draft sill during coupling. In some embodiments, the shelf may be less than 2 inches above a bottom edge of the coupler.

Figure 11:
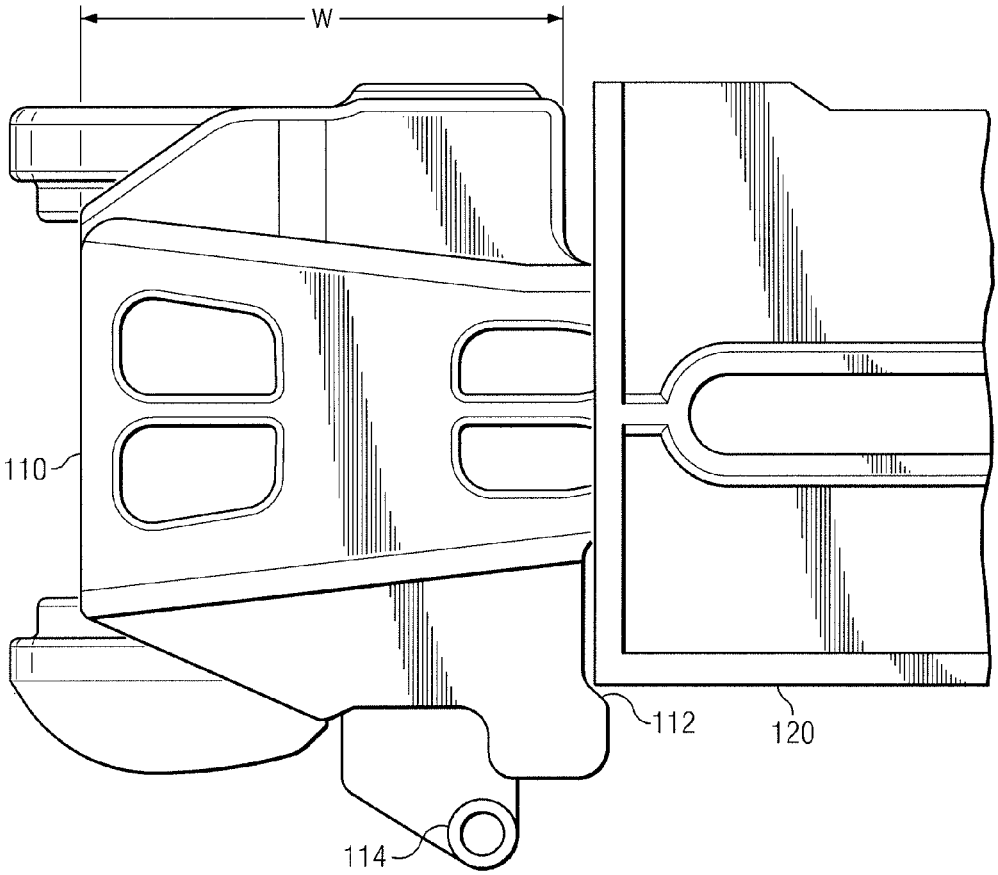
FIG. 11 is a partial view of a railcar coupler engaged with a coupler assembly, in accordance with a particular embodiment.

FIG. 11 illustrates another view of coupler 110 of FIG. 10. Coupler 110 includes a reduced width W (in this case 10.75 inches) as discussed above with respect to other couplers to allow for longer coupler travel. Also illustrated is locklifter assembly 114 and the coupling assembly showing striker 120 in an engaging operation with the coupler. As illustrated, the lowering of shelf 112 (in this case 0.5 inches) as discussed above with respect to FIG. 11 provides more room for the coupler to travel without impacting striker 120.

Figure 12:
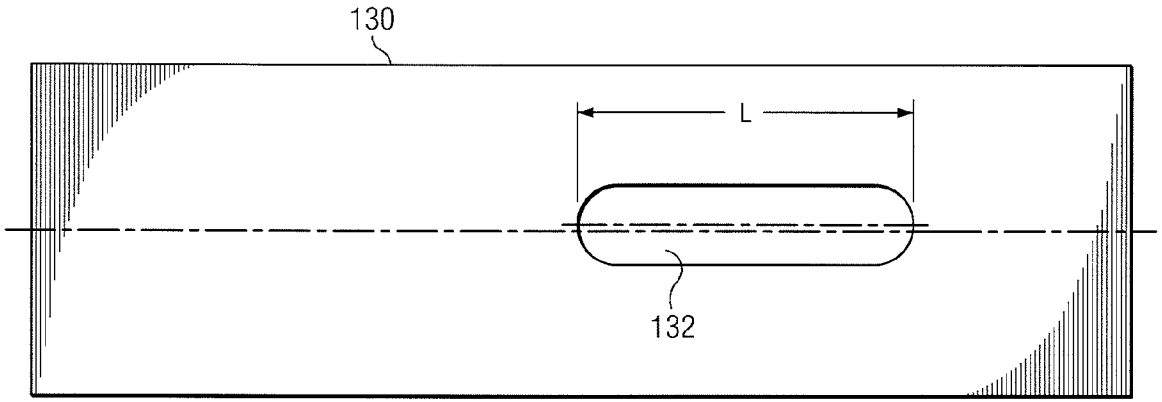
FIG. 12 is a side view of a shank of a conventional railcar coupler.

FIG. 12 illustrates a side view of a shank 130 of a conventional coupler. Shank 130 includes a shank slot 132. Shank slot 132 typically has a length L of 6.875 inches.

Figure 13:
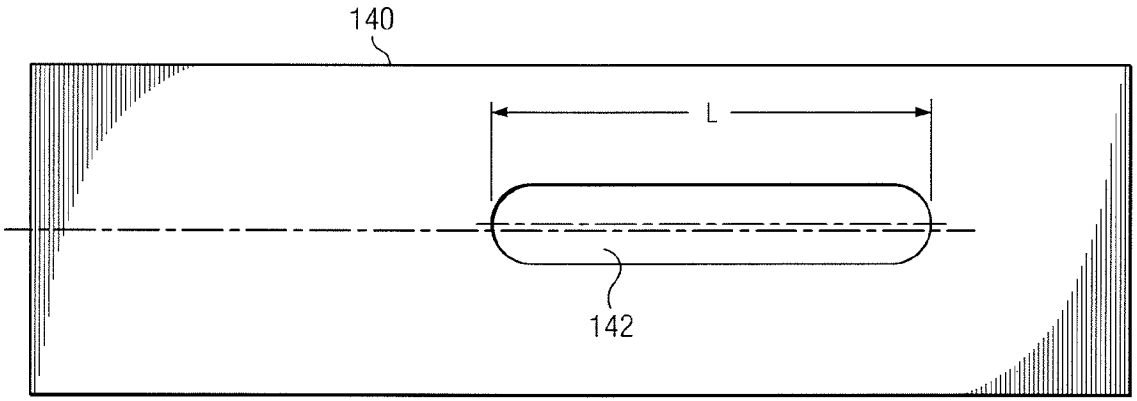
FIG. 13 is a side view of a shank of a railcar coupler, in accordance with a particular embodiment.

FIG. 13 illustrates a side view of a shank 140 of a coupler, in accordance with a particular embodiment. Shank 140 includes a shank slot or key slot 142. The length of shank slot 142 is increased over the length of shank slots in conventional couplers to allow for longer travel of the coupler that is also facilitated by the reduced coupler width as described above. The length L of shank slot 142 is approximately 9.000 inches. This increased slot length provides for more room for the key which couplers the coupler to the yoke to travel during railcar coupling. In particular embodiments with longer travel coupler changes described above, if the key slot was not lengthened then the yoke may contact the front draft stops of the center sill, which would stop the draft gear. While in this embodiment the length L of shank slot 142 is increased by approximately 2.125 includes to equal approximately 9.000 inches, the length of shank slots in other embodiments may be increased in other ways to enable longer coupler travel. In some embodiments, the length of a shank slot may be greater than 8 inches.

Technical advantages of particular embodiments include a railcar coupler that is reconfigured to allow for longer travel during railcar coupling. In some embodiments, the coupler has a width reduced by approximately 1.25 inches. Generally, in particular embodiments that back of the coupler horn is moved 1.25 inches. In addition, in particular embodiments the locklifter shelf is moved down approximately 0.5 inches to prevent it from impacting the draft sill of the striker. In some embodiments, the shank slot is elongated by approximately 2.125 inches to further allow for longer travel.

Although the present invention has been described in detail with reference to particular embodiments, it should be understood that various other changes, substitutions, and alterations may be made hereto without departing from the spirit and scope of the present invention. The present invention contemplates great flexibility in the manufacturing process of coupler knuckles and the shape, configuration and arrangement of one or more internal cores used in the manufacturing process.

Numerous other changes, substitutions, variations, alterations and modifications may be ascertained by those skilled in the art and it is intended that the present invention encompass all such changes, substitutions, variations, alterations and modifications as falling within the spirit and scope of the appended claims.

What is claimed is:

1. A railcar coupler, comprising:

a coupler head portion extending from a shank portion, the coupler head portion configured to couple to a first coupler knuckle for coupling the railcar coupler to a second railcar coupler of an adjacent railcar;

the coupler head portion comprising a nose portion and a gathering face extending from the nose portion for engaging a second coupler knuckle coupled to the second railcar coupler;

the coupler head portion comprising a guard arm portion extending from the nose portion towards the shank portion;

the coupler head portion comprising a configuration allowing for greater than 4.5 inches of travel distance with respect to a railcar striker during coupling to the second railcar coupler of the adjacent railcar while a distance between a nose end of the guard arm portion and the railcar striker is 15.75 inches before the coupling to the second railcar; and wherein the coupler head portion comprises a horn portion having a back surface, wherein a distance between the back surface of the horn portion and a nose end of the guard arm portion is less than 11 inches and the back surface of the horn portion has a wall thickness of less than 0.5 inches.

2. The railcar coupler of claim 1, wherein the coupler head portion comprises a locklifter shelf less than approximately 2 inches above a bottom edge of the coupler.

3. The railcar coupler of claim 1, wherein the shank portion comprises a key slot having a length greater than approximately 8 inches.

4. A method for manufacturing a railcar coupler, comprising:

casting a coupler head portion extending from a shank portion, the coupler head portion configured to couple to a first coupler knuckle for coupling the railcar coupler to a second railcar coupler of an adjacent railcar;

the coupler head portion comprising a nose portion and a gathering face extending from the nose portion for engaging a second coupler knuckle coupled to the second railcar coupler;

the coupler head portion comprising a guard arm portion extending from the nose portion towards the shank portion; and the coupler head portion comprising a configuration allowing for greater than 4.5 inches of travel distance with respect to a railcar striker during coupling to the second railcar coupler of the adjacent railcar while a distance between a nose end of the guard arm portion and the railcar striker is 15.75 inches before the coupling to the second railcar; and wherein the coupler head portion comprises a horn portion having a back surface, wherein a distance between the back surface of the horn portion and a nose end of the guard arm portion is less than 11 inches and the back surface of the horn portion has a wall thickness of less than 0.5 inches.

5. The method of claim 4, wherein the coupler head portion comprises a locklifter shelf less than approximately 2 inches above a bottom edge of the coupler.

6. The method of claim 4, wherein the shank portion comprises a key slot having a length greater than approximately 8 inches.

* * * * *